United States Patent [19]

Schenk

[11] 4,207,814

[45] Jun. 17, 1980

[54] APPARATUS FOR PRINTING SERIAL NUMBERS WITH CHECK DIGITS

[76] Inventor: William D. Schenk, 270 Pryor Ave., Tonawanda, N.Y. 14150

[21] Appl. No.: 895,513

[22] Filed: Apr. 11, 1978

Related U.S. Application Data

[63] Continuation of Ser. No. 755,940, Dec. 30, 1976, abandoned, which is a continuation-in-part of Ser. No. 623,431, Oct. 17, 1975, abandoned.

[51] Int. Cl.[2] ..... B41L 49/02; B41J 3/02; B41F 3/86

[52] U.S. Cl. ..... 101/76; 101/85; 101/110; 400/144.2; 235/437

[58] Field of Search ..... 101/72, 76, 77, 90, 101/84–88, 232, 233, 110, 109, 91; 400/144.1, 144.2; 235/61.7 A

[56] References Cited

U.S. PATENT DOCUMENTS

| | | | |
|---|---|---|---|
| 2,821,916 | 2/1958 | Miles | 101/233 |
| 2,825,279 | 3/1958 | Gottscho | 101/110 |
| 3,166,243 | 1/1965 | Torre | 101/72 |
| 3,406,628 | 10/1968 | Le Gault | 101/90 |
| 3,420,163 | 1/1969 | Ritzerfeld | 101/91 |
| 3,427,961 | 2/1969 | Eggeringhaus | 101/110 |
| 3,573,589 | 4/1971 | Berry | 101/91 |
| 3,598,044 | 8/1971 | Hutchinson | 101/76 |
| 3,603,251 | 9/1971 | Elsworth | 101/76 |
| 3,650,205 | 3/1972 | Wybrow et al. | 101/72 |
| 3,707,214 | 12/1972 | Ponzano | 400/144.2 |
| 3,728,960 | 4/1973 | Heath | 101/76 |
| 3,734,010 | 5/1973 | Le Gault et al. | 101/79 |
| 3,782,277 | 1/1974 | Neal | 101/76 |
| 3,815,495 | 6/1974 | Strackbein | 101/76 |
| 3,833,795 | 9/1974 | Shoshani et al. | 101/110 |

OTHER PUBLICATIONS

Lavin et al., "Printing Numbering Head . . . "IBM Technical Disclosure Bulletin, vol. 10, No. 12, p. 1873, 5/68.

*Primary Examiner*—William Pieprz

*Attorney, Agent, or Firm*—Leydig, Voit, Osann, Mayer & Holt, Ltd.

[57] ABSTRACT

Method and apparatus for use in numbering a series of successively fed documents with consecutive serial numbers and corresponding check digits, including weighted, non-sequential check digits. The check digits are independently applied by a single, engraved wheel mounted on the periphery of a rotating sleeve and positioned by an eccentrically-mounted electronically-controlled stepping motor, with the consecutive serial numbers being applied by a conventional consecutive decimal numbering head mounted to a separate, rotating shaft. Multiple check digit wheels and/or multiple consecutive decimal numbering heads may be employed.

10 Claims, 11 Drawing Figures

APPARATUS FOR PRINTING SERIAL NUMBERS WITH CHECK DIGITS

REFERENCE TO RELATED APPLICATION

This is a continuation of application Ser. No. 755,940, filed Dec. 30, 1976, which in turn was a continuation in part of application Ser. No. 623,431 filed Oct. 17, 1975, both now abandoned.

DESCRIPTION OF THE INVENTION

This invention relates to a method and apparatus for use in numbering a series of successively fed documents with consecutive serial numbers and corresponding check digits, including non-sequential check digits.

In many data processing applications, an error in the serial number assigned to a given account can have serious consequences. For example, hospital patients are often assigned a number upon admission which thereafter is used in maintaining a record of treatment and in the computerized billing of medication, X-rays, laboratory tests, etc., to the patient's account. An error in the transmission of the serial number could result in an erroneous treatment record and patient charges.

Check digits offer a method of screening errors which appear on the face of the serial number. One known system employs a random number generator to generate a random check digit for each serial number, with the serial number/check digit ordered sets being stored in the memory of a computer for later authenticity verification. See, e.g. U.S. Pat. No. 3,833,795. More typically, however, a single check digit which bears a mathematical relationship to the serial number is printed along with the serial number. The serial number/check digit combination may then be checked for internal consistency by performing the particular mathematical operation on the serial number. Depending on the mathematical relationships employed, large percentages of potentially serious and costly errors can be detected and corrected at the initial stages of processing the data.

There are often printed documents such as invoices or purchase order forms associated with a data processing application such as described briefly above. It is often desirable that these forms be pre-numbered with the serial numbers and check digits. Indeed, in many cases the document itself may serve as the source of the serial number/check digit combination assigned to a particular account. A method and apparatus for numbering the documents accurately and efficiently is required.

It is well known to apply consecutive serial numbers to documents by the use of numbering heads having a plurality of wheels numbered 0-9 and interconnected to index according to the decimal system. This type of numbering system is relatively inexpensive and offers the further advantage of relatively high speed operation. Often this type of numbering system can be incorporated as an additional step in the printing or collating operation to minimize the capital and handling costs.

The requirement that a check digit be applied to the document in addition to the serial number increases the complexity of the above-described serial numbering operation to an extent dependent upon the particular check digit system used. In the random number-type system, a random number generator is necessary to generate the random numbers. Means for converting electronic signals representing the random numbers into commands to position the random numbering printing mechanism are required. Further, a computer memory is required for storage of the ordered sets of serial numbers and random numbers. With reference to the mathematical relationship-type of check digit system, there are several specific check digit systems which have been employed: Check 7, Check 9, Check 11, Modulus 10 and Modulus 11, to name a few. In the first three systems, the check digits sequence regularly such that an engraved wheel having a shaft in common with a conventional, consecutive numbering head can be employed to print check digits as suffixes to the serial numbers through the use of a relatively simple, pre-programmed mechanically actuated indexing system. An example of this type of system is disclosed in U.S. Pat. No. 3,650,205. In this exemplary system, however, the single-shaft arrangement of the serial numbering heads and check digit engraved wheels provides little latitude in the orientation and/or relative positioning of the check digits and serial numbers. A further disadvantage inherent in all of the pre-programmed mechanically-actuated systems designed for the application of check digits according to the Check 7, Check 9 and Check 11 system is that the error detection capabilities of the Check 7, Check 9 and Check 11 systems may be unsuitable for some applications, requiring employment of the Modulus 10 or Modulus 11 systems.

In the Modulus 10 and 11 systems, however, the check digits are weighted and do not always sequence in a regular fashion. As a result, sophisticated mechanically-actuated indexing systems or computer-controlled electronic print-out devices have been employed. Examples of systems which have been developed for use with some weighted check digit systems are disclosed in U.S. Pat. Nos. 3,603,251, 3,734,010, 3,815,495 and IBM Technical Disclosure Bulletin, Volume 10, No. 12, May 1968, "Printing Numbering Head for Self-Checking Numbers, Modulus 11".

In applications where weighted-type check digit systems are to be employed, each of the above-referenced exemplary systems is subject to several disadvantages. U.S. Pat. Nos. 3,603,251 and 3,815,495 are rotary press-type systems which employ one or more conventional serial numbering heads with check digit engraved wheels sharing common shafts with the serial numbering heads. As such the systems have the disadvantages associated with a single shaft arrangement, as explained above. Also, in each case the systems are pre-programmed specifically for Modulus 10 applications. In each case the indexing systems employ solenoid-actuated stops, the orientation and configuration of which would seem to restrict such systems to single modes of operation. U.S. Pat. No. 3,734,010 is a high-speed ribbon-and-platen-type system which employs multiple, computer-controlled stepping motors to position the several serial number and check digit wheels arranged on a common shaft. While such a system is potentially adaptable to a variety of serial number and check-digit systems by re-programming of the computers as required, the multiple stepping motor and computer arrangement renders such a system relatively expensive. In addition, with such a common shaft arrangement, the orientation and relative positioning of the check digits and serial numbers is rigid as in the previously described systems.

In the last mentioned reference, only the printing head itself is briefly discussed, with no suggestion of how it might be employed in a printing operation.

In addition to the specific considerations discussed above, to the extent a check digit system does not permit high speed, on-line processing of the documents as a supplemental step to the printing or collating operation, capital and handling costs are likely to increase.

Furthermore, since even with weighted-type check digit systems the serial numbers themselves may often be applied in conventional fashion, systems which require replacement of otherwise acceptable serial numbering equipment, or extensive modification thereto, do not effectively utilize the existing equipment.

Accordingly, it is an object of the present invention to provide a simplified electro-mechanical method and apparatus for on-line numbering of documents with consecutive serial numbers and check digits, including weighted, non-sequential check digits.

Another object of the present invention is to provide a method and apparatus for numbering documents with consecutive serial numbers and check digits which provide latitude in the orientation and relative positioning of the check digits and serial numbers.

It is a more specific object of the present invention to provide a method and apparatus for numbering documents with consecutive serial numbers and check digits which require individual external control of only the check digit printing wheel.

A further object is to provide a method and apparatus for applying weighted, non-sequential, check digits at speeds compatible with conventional printing and collating operations.

Still another object is to provide a method and apparatus readily adaptable for the application of check digits according to any of a variety of check digit systems.

Yet another object of the present invention is to provide a check digit numbering apparatus which may be employed with conventional serial numbering apparatus without extensive modification thereto.

These and other objects and advantages of the invention will become apparent upon reading the following detailed description and upon reference to the drawings in which.

Figure 1:
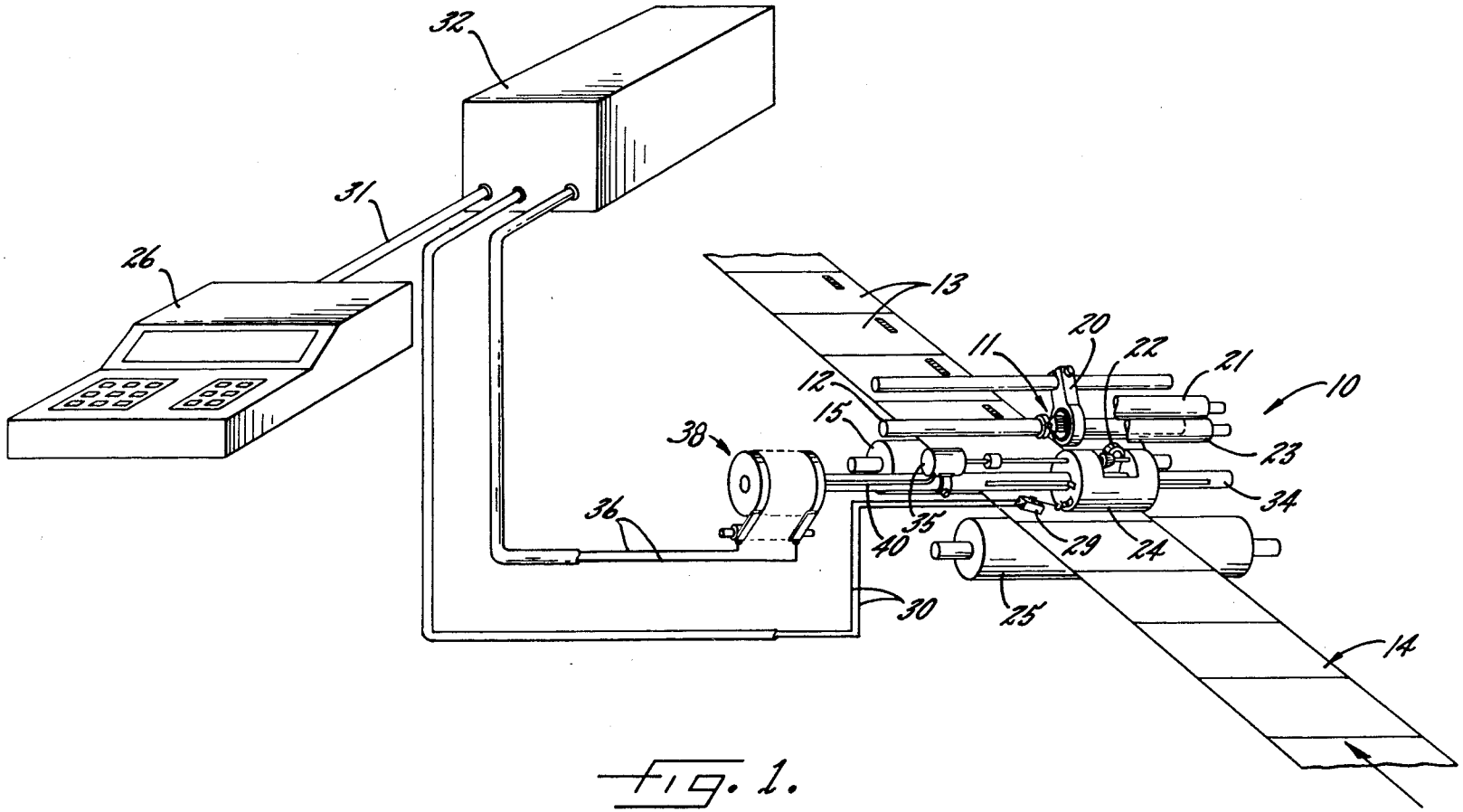
FIG. 1 is a perspective view of a check digit printing apparatus according to the present invention.
Figure 2:
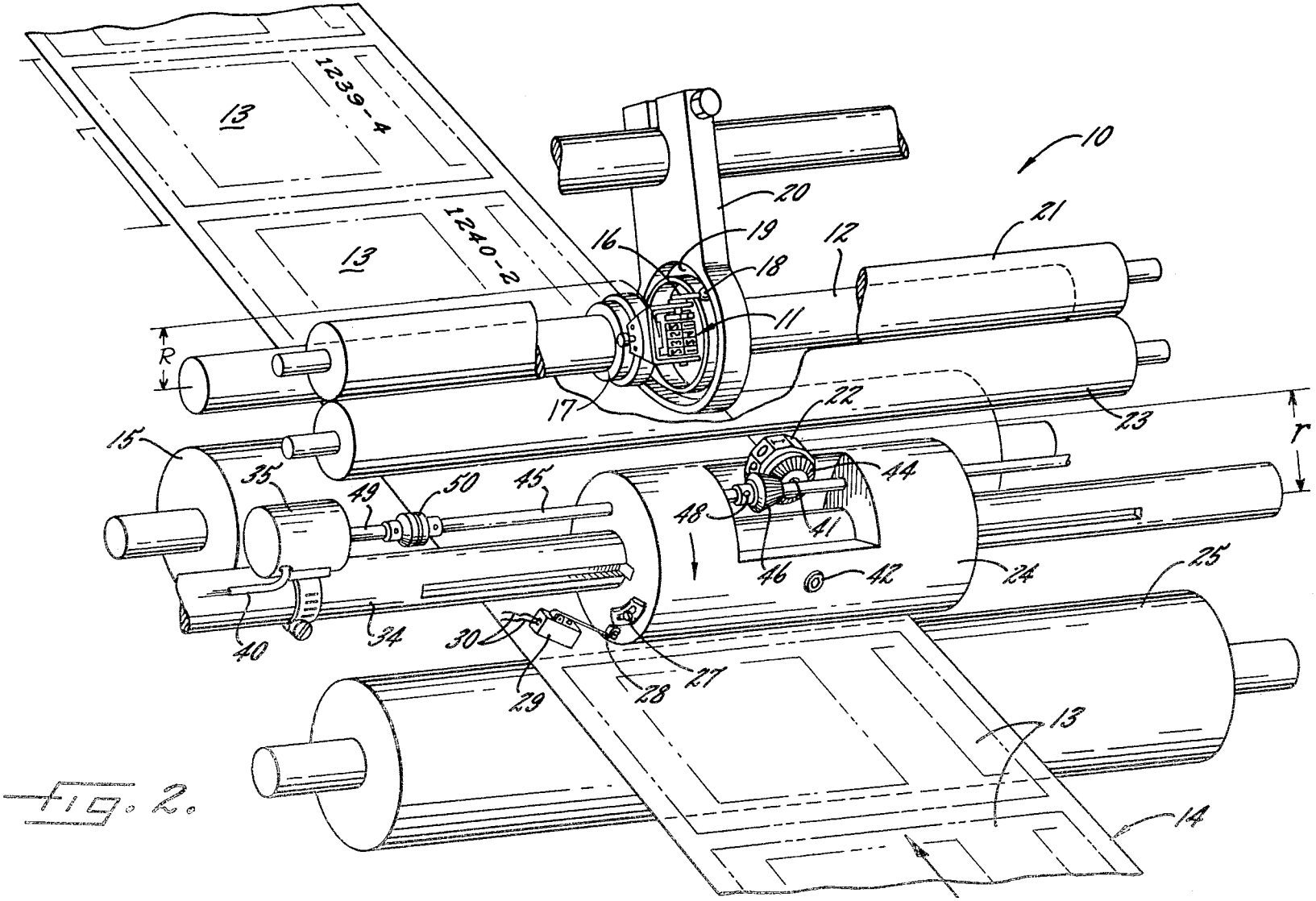
FIG. 2 is an enlarged perspective view of the check digit printing wheel mounting and driving arrangement shown in FIG. 1.
Figures 3A, 3B, 9, 10:
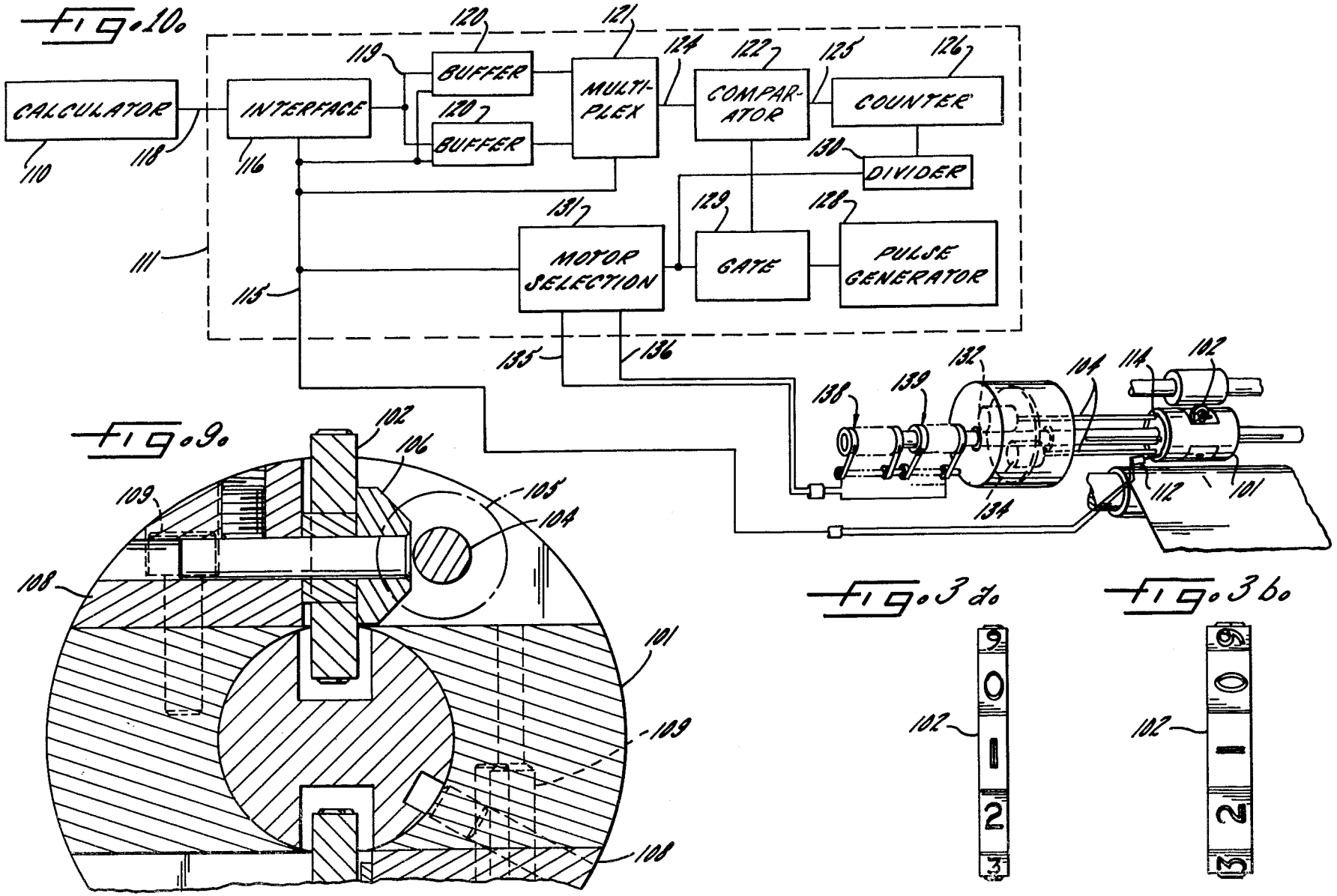
Figure 4:
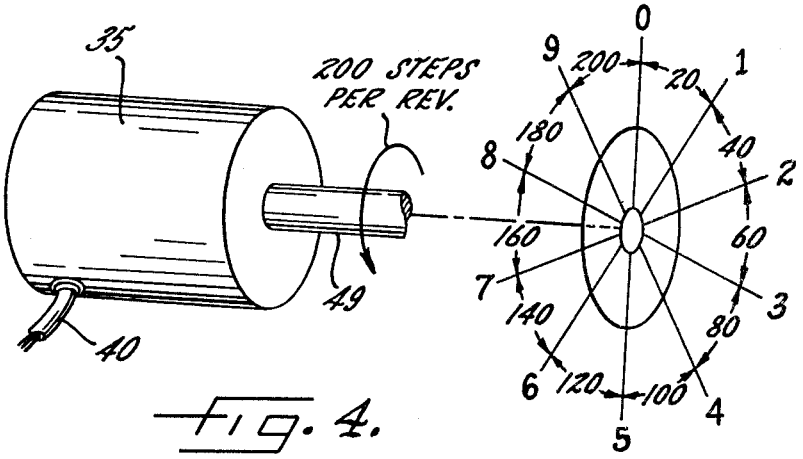
Figure 6:
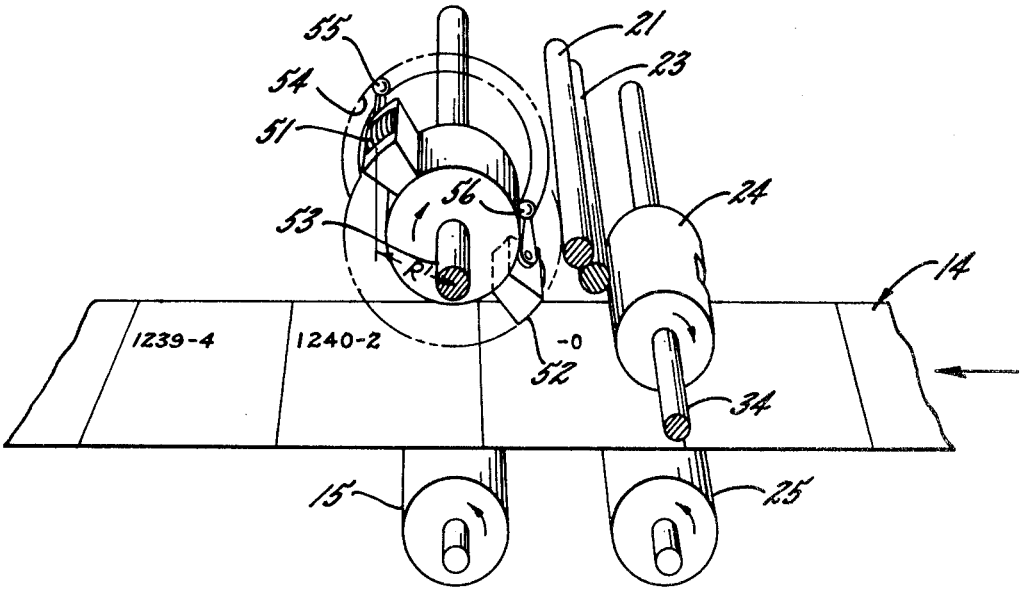
Figure 5A:
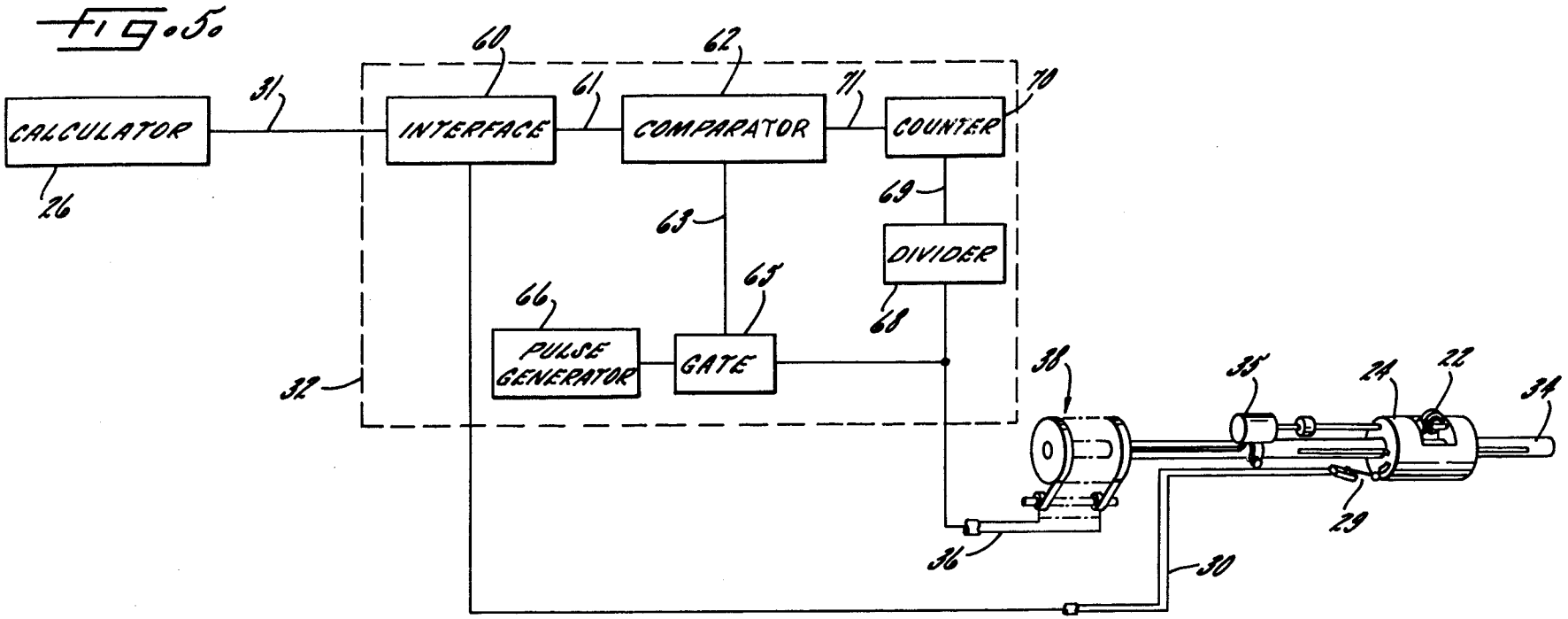
Figure 7:
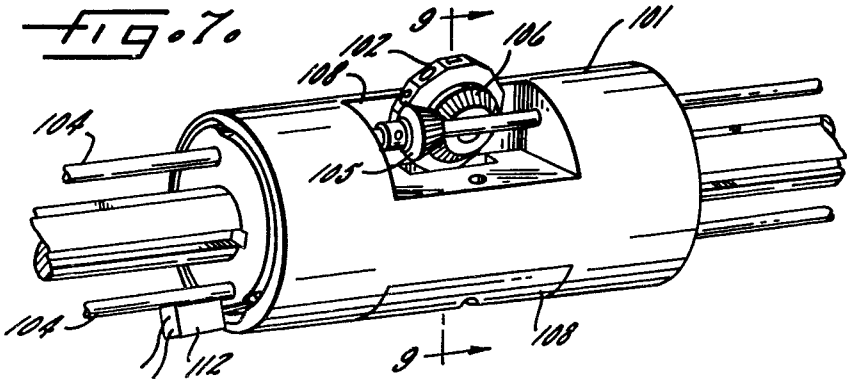
Figure 8:
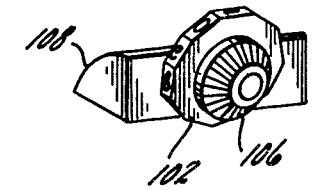

FIGS. 3*a* and 3*b* are side elevational views of check digit wheels showing alternative check digit orientations according to the present invention;

FIG. 4 is a pictorial view illustrating the relationship between the steps of a stepping motor and the digits of a numbering wheel driven by said motor;

FIG. 5 is a block diagram functionally illustrating a control system which may be employed with the embodiment of the invention shown in FIGS. 1–3;

FIG. 6 is a perspective view similar to that of FIG. 2 showing an alternative embodiment of the invention employing multiple serial numbering heads;

FIG. 7 is a perspective view of a sleeve according to another embodiment of the invention;

FIG. 8 is a perspective view of the selectively removable check digit number wheel mounting arrangement employed in the sleeve shown in FIG. 7;

FIG. 9 is a sectional view of the check digit sleeve shown in FIG. 7; and FIG. 10 is a combined pictorial view of the multiple check digit numbering wheel embodiment of the invention of FIG. 7–9 and a functional block diagram illustrating a control system which may be employed with the multiple check digit numbering wheels.

DETAILED DESCRIPTION OF THE INVENTION

While the invention is susceptible of various modifications and alternative forms, specific embodiments thereof have been shown by way of example in the drawings and will hereinafter be described in detail. It should be understood, however, that it is not intended to limit the invention to the particular form disclosed, but to the contrary, the invention is to cover all modifications, equivalents and alternatives falling within the spirit and scope of the invention as expressed in the appended claims.

Briefly describing the operation of the system, a conventional numbering head mounted for rotary press-type operation is utilized to apply consecutive serial numbers to a series of successively fed documents, i.e., a continuous web of printed forms, as it passes through the apparatus. According to an important aspect of the present invention an individually controlled check digit print head, herein shown in the form of an engraved printing wheel, similarly, but independently, mounted for rotary press-type operation is employed to apply appropriate check digits to each of the serially numbered forms. In many applications, each check digit is applied immediately following its associated serial number, as a suffix, e.g. 12345-6 and 12345 being the serial number and 6 being the check digit. The present invention, however, is not limited to this format. As discussed in detail below, according to the present invention, the independent mounting of the check digit engraved wheel permits not only the independent selection of the orientation of the check digit and of the serial number but also the independent positioning of the check digit and of the serial number relative to one another.

In keeping with the present invention, only the check digit wheel need be specially controlled, the digits of the serial numbers being consecutively advanced according to known methods such as, for example, a cam and follower actuation system to advance the units digit at a point in time between the printing of two successive serial numbers. According to another aspect of the present invention, the check digit wheel is positioned to print the appropriate check digit by means of a stepping motor mounted directly upon the rotating check digit assembly. Following each check digit printing step, the stepping motor receives conditioned, electronically-generated signals to drive the check digit wheel from its previous position into that necessary to print the next appropriate check digit.

Turning specifically to the drawings, FIGS. 1 and 2 illustrate a conventional serial numbering apparatus having associated therewith a check digit numbering apparatus 10 according to the present invention. For the purpose of printing the consecutive serial numbers a conventional decimal numbering head 11 having, typically, from 4 to 8 interconnected engraved wheels is mounted to a collar 17 on a rotating shaft 12 to apply, in rotary press fashion, a consecutive serial number to each document 13 of a continuous web 14 as it passes between the impression cylinder 15 and the exposed digits (shown in FIG. 2) of the numbering head 11. In conventional fashion, to assure that the exposed digits are freshly inked for each printing operation, inking roller 21 inks the exposed digits of the numbering head 11 prior to printing the serial numbers on the documents 13.

According to known techniques the advancement of the units digit of the numbering head 11 is achieved by an actuating lever 16 (best illustrated in FIG. 2). In the apparatus shown, the spherical follower 18 at the end of the lever 16 maintains contact with the surfaces of annular cam slot 19 of the bracket 20 as the shaft 12 rotates. The cam slot 19 is designed to effect the advancement of the units digit of the numbering head 11 once during each revolution of the shaft 12. As a result of the mechanical cam, consecutive serial numbers are applied to the forms 14 with no additional external control after the numbering head 11 has been pre-set to the desired serial number prior to start up.

Those skilled in the art will appreciate that the surface speed of the numbering head engraved wheel printing surfaces is coordinated with the surface speed of the web 14 to be equal thereto, resulting in smooth, smearless printing of the serial numbers upon the documents. In addition, the effective printing radius R of the numbering head 11 is chosen such that the circumference traced by the engraved wheel printing surfaces is equal to the length L of each document 13. With such a relationship, the serial numbers will be printed in the same location on each document. This location is determined by the phase correspondence of the serial number printing cycle with the documents 13 as they pass between the numbering head 11 and the impression roller 15. That is, the operation of the apparatus may be adjusted to print the serial number shortly after the leading edge of a document passes the printing station, shortly before the trailing edge of a document passes the printing station, or at any point between these extremes.

Lateral adjustment of the serial numbering head 11 with respect to the web 14 by sliding the collar 17 along the shaft 12 permits the serial numbers to be printed in any lateral position on the documents 13. The bracket 20 is similarly laterally adjustable to maintain the proper relationship with the spherical follower 18.

Having described the method and apparatus for the serial number application, the method apparatus according to the present invention for applying the check digits will be described.

In accordance with an important aspect of the present invention, check digits calculated from the serial numbers are applied in a manner similar to, but independent from, that used for applying the serial numbers. To this end, a single wheel 22 with digits (shown in FIG. 2) engraved around its periphery is mounted for rotation on a pin 41. The pin 41 is mounted in cantilevered fashion to the sleeve 24; and the sleeve 24 is keyed to shaft 34 for simultaneous rotation therewith. With this arrangement as the shaft 34 rotates, the exposed engraved surface of wheel 22 cooperates with the inking roller 23 and impression cylinder 25 to apply a check digit to each document. As with the serial numbering head, the effective printing radius r of the wheel 22 and the surface speed thereof are chosen such that the check digits are printed in the same location on each document. The keyed arrangement between the sleeve 24 and the shaft 34 facilitates lateral adjustment of the sleeve, and hence, of the printing wheel 22, with respect to the web of forms 14. Relative movement between the sleeve 24 and the shaft 34 may be prevented during the operation through the tightening of a set screw 42.

From the above description, it will be appreciated that, in keeping with the present invention, the lateral printing positions of the check digit wheel and of the serial numbering head may be independently selected. Further, by adjustment of the phase of the check digit shaft 34 with respect to that of the serial numbering shaft 12, the relative spacing of the check digits and serial numbers along the line of travel of the web 14 may be varied. That is, the check digit may be printed before, after, or, if the lateral spacing of the check digits and serial numbers permits, aligned with the serial number.

Further flexibility in the set up and operation of the method and apparatus of the present invention is possible. Referring to FIGS. 3*a* and 3*b* there are shown alternative engraving patterns for the check digit wheel. The pattern shown in FIG. 3*a* is that employed in the embodiment of the invention shown in FIGS. 1 and 2. The pattern shown in FIG. 3*b* could be employed in an embodiment of the invention (not illustrated) in which the serial numbering head is mounted with its exposed digits arranged to print parallel to the axis of rotation of the shaft to which it is mounted instead of perpendicular thereto as in the embodiment shown in FIGS. 1 and 2. By so changing the printing orientations of the check digit printing wheel and of the serial numbering head while retaining the independent lateral and phase adjustment capabilities of these respective components, the method and apparatus described herein affords maximum printing format versatility.

Referring again to FIG. 2 in order to permit driving the wheel 22 through a drive shaft 45 arranged parallel to shaft 34, congruent bevel gears 44 and 46 are employed. Through this arrangement rotation of shaft 45 causes synchronous rotation of the engraved wheel 22. Shaft 45 is journalled in sleeve 24, with set screw 48 facilitating adjustment as necessary to maintain the proper driving relationship between the bevel gears 44 and 46 with the lateral adjustment of the sliding sleeve 24.

To effect the positioning of the check digit wheel 22, a stepping motor 35 eccentrically mounted to a shaft 34 drives shaft 46. To compensate for any minor misalignment of the two shafts 45 and 49 a flexible coupling 50 is provided. Through this arrangement, as shaft 34 rotates, the stepping motor "orbits" about the axis of shaft 34, with any rotation of stepping motor output shaft 49 effecting the rotation of engraved wheel 22 about its own axis.

FIG. 4 shows in detail how a 200 step-per-revolution stepping motor 35 may be used to drive a wheel 22 having the digits 0–9 engraved thereon. It should be understood that a stepping motor having any number of steps evenly divisible by the number of digits engraved around the circumference of the engraved wheel may be used. In the illustrated case, 20 steps are required to advance or retract the engraved wheel by one digit. This or any other ratio between the stepping motor steps and the engraved wheel digits may be readily accommodated by adapting the stepping motor control system, discussed below, accordingly.

A control system successfully employed with a prototype of the embodiment of the serial number/check digit apparatus illustrated in FIGS. 1 and 2 is shown in block diagram form in FIG. 5. Describing the operation of the control system illustrated, following each printing cycle, a calculator 26 (e.g. Hewlett Packard Series 9800 programmable calculator) is employed to generate signals subsequently conditioned by the interface/controller 32 to drive the stepping motor from the position associated with the previous check digit printing cycle into that necessary for the next check digit printing cycle. For example, if the previously calculated and printed check digit was 5 and the check digit calculated to be printed for the next cycle is 8, the control system generates a signal to drive the stepping motor from its position employed to print the check digit 5 into the position required to print the check digit 8. It will be appreciated that the appropriate signal is dependent upon the quantity and arrangement of numeric characters on the check digit wheel as well as upon the direction of rotation of said wheel and the characteristics of the particular stepping motor employed. Using an engraved wheel 22 having the numberic characters 0–9 engraved around its periphery and employing a 200 step-per-revolution stepping motor 35 (FIG. 4), the appropriate signal in the above case would be to drive the stepping motor through 60 steps, advancing the engraved wheel 3/10th of a revolution from the 5-position into the 8-position.

To generate a timing pulse, upon the completion of each check digit printing cycle, a trip 27 is provided which actuates the probe 28 of a switch 29. As shown in FIG. 5, this timing pulse is transmitted via lines 30 to the interface circuit 60 within the interface/controller 32.

The system timing is such that at the time the timing pulse is transmitted to the interface circuit 60, the calculator 26 has calculated the increment by which the check digit engraved wheel 22 must be advanced from its present position in preparation for the printing of the next-to-be printed check digit, i.e., 3 digits or 60 stepping motor steps in the 5-to-8 example discussed above. Upon receipt by the interface circuit 60 of the timing signal via line 30, the calculator 26 conveys its information, in steady state binary coded decimal form, via multiple conductor line 31 to said interface circuit.

The steady state BCD output of the calculator 26 is transmitted through the interface circuit 60 as a steady state BCD input 61 to a comparator circuit 62. To generate pulses to drive the stepping motor 35, there is provided a pulse generator 66. To selectively transmit the pulse generator signals to the stepping motor 35, a gate 65 is interposed between the pulse generator 66 and the stepping motor control lines 36. The binary output 63 of the comparator circuit 62 controls the operation of the gate 65. A brush and slip ring arrangement indicated generally at 38 transmit the electrical signal in the control lines 36 to the leads within the stepping motor input cable 40. The output of the pulse generator 66, as transmitted through the gate 65, also passes through a divider 68. This divider 68 reduces the frequency of the gate output by the number of stepping motor steps per check digit wheel position, e.g. 20 in the embodiment shown in FIG. 4. The pulsed divider output 69 is then fed to a counter 70 which generates a dynamic BCD output 71 instantaneously corresponding to the number of pulses received by the counter 70. This BCD output 71 is continuously compared in the comparator 62 to the steady state BCD output 61 of the interface 60. When the BCD inputs 61 and 71 to the comparator 62 are equal, the comparator output 63 disables the gate 65, interrupting the transmission of pulses from the pulse generator 66 to the stepping motor 35. In this manner, the stepping motor is advanced into the position required for the printing of the next check digit.

An alternative embodiment is shown in FIG. 6. This embodiment differs from that showing in FIGS. 1 and 2 in that two serial numbering heads 51 and 52 are mounted on shaft 53 with their effective printing radii R′ twice that of the check digit numbering wheel (not shown) mounted to the sleeve 24 in the same manner as illustrated in detail in FIGS. 1 and 2. In order to print sequential serial numbers on the web 14, the surfaces of cam slot 54 are designed to actuate the lever arms 55 and 56 twice each per revolution of shaft 53. This embodiment has the advantage of reducing the rotational speed of the serial numbering equipment for given web surface speeds. In other respects the embodiment is similar to that described above and shown in FIGS. 1 and 2. A control system for this embodiment could be identical to that illustrated in FIG. 5.

Additional versatility may be introduced into the serial number/check digit printing method and apparatus according to the invention by employing two check digit numbering wheels spaced 180° apart on a rotating sleeve in conjunction with, for example, four equally spaced serial numbering heads mounted to a rotating shaft. In such an arrangement, the effective printing radius of the serial numbering heads would be twice that of the check digit wheels. Such a system would have as one of its advantages two modes of operation: a first mode wherein all four serial numbering heads and both check digit wheels print on forms having a length equal to half the effective printing circumference of the check digit sleeve, and a second mode wherein every other one of the serial numbering heads and one of the check digit wheels is deactivated, with the operative ones printing on forms having a length equal to the total effective printing circumference of the check digit sleeve.

A sleeve 101 adapted for the dual check digit numbering wheels 102 of this embodiment of the invention is shown in FIG. 7. Describing the dual check digit wheel sleeve, each of the check digit wheels 102 employed in this embodiment has associated therewith a drive system equivalent to that illustrated in connection with the single check digit wheel arrangement illustrated in FIGS. 1 and 2. That is to say, stepping motors (items 132 and 134 in FIG. 10) drive shafts 104, which in turn drive, through bevel gears 105 and 106, the engraved check digit wheels 102.

To facilitate the selective deactivation of one or the other of the check digit wheels, provision is made for removing the portions of the sleeve 101 to which the check digit wheels are mounted. FIG. 8 illustrates a check digit wheel 102 and the block 108 to which the wheel is mounted. The arrangement is also illustrated in FIG. 9, which is a partial sectional view of the sleeve illustrated in FIG. 7. As shown in FIG. 9, cap screws 109 serve to attach the blocks 108 to the main body of the sleeve 101. This arrangement facilitates the selective removal of either of the blocks 108 and the check digit wheel 102 associated therewith should it be desired to operate the apparatus with a single check digit wheel.

It will be appreciated that a control system for a dual check digit arrangement as illustrated in FIGS. 7 to 9 must, in addition to calculating the incremental advancements of the check digit wheels and generating the stepping motor inputs necessary to effect such advancements, include some degree of storage and memory capability to keep track of the respective positions of the two check digit wheels as well as means to selectively drive the two stepping motors. In addition, as a printing operation must occur at each half revolution of the check digit sleeve when both check digit wheels are in operation, it is advantageous to take measures to effect as rapid check digit wheel positioning as possible to permit high speed operation. FIG. 10 illustrates a control circuit for driving a dual check digit system as illustrated in FIGS. 7 to 9.

In the circuit shown in FIG. 10, provision is made for controlling two stepping motors from a single calculator 110 (e.g. Hewlett Packard Series 9800 programmable calculator). An associated interface/controller circuit 111 having incorporated therein buffer circuits for information storage and a multiplex circuit coordinate the retrieval of information from the buffers with the stepping motor operation. Describing the operation of the control circuit, during each 180° of revolution (hereinafter referred to as a half cycle) of the check digit sleeve 101, one of the two buffer circuits receives calculator-generated information for use during the next half cycle, while the other of the buffer circuits transmits to the remainder of the control circuit the calculator-generated information entered therein during the previous half cycle. Upon completion of a half cycle, the buffer circuit operations are switched, with the one having the newly entered calculator-generated information being connected to transmit that information to the remainder of the control circuit, and the previously transmitting buffer circuit connected to receive newly calculator-generated information for use during the next half cycle. In this manner, the computations by the calculator may be made in advance of the half cycle during which the information will be used, allowing a complete half cycle to effect the stepping motor advancement.

It will be appreciated that with the two check digit wheel arrangement, the calculator must be programmed to store information on the position of each stepping motor separately and calculate the incremental advance information for each stepping motor based upon the previous position of that stepping motor. This results from the fact that although the check digits are calculated from successively applied serial numbers, they are applied alternately by the two check digit wheels. By way of example, if four successive check digits are 2, 6, 3 and 9, the check digit wheel which prints the first check digit 2, must, at the appropriate time, be advanced one digit to print the third check digit 3. Similarly, the other check digit wheel, which prints the second check digit 6, must be advanced three digits to print the fourth check digit 9.

Referring to FIGS. 7 and 10 for a more detailed description of the dual check digit control system illustrated, the timing for this system is provided by the output of a cam actuated switch 112. The follower of the switch 112 cooperates with the cam surface 114 in a known manner to provide a binary DC signal 115 having one level during the half revolution of the sleeve 101 immediately following the printing of a check digit by one of the engraved wheels 102 and a second level during the half revolution of the sleeve 101 immediately following the printing of a check digit wheel by the other of the engraved wheels 102. With this arrangement, the signal 115 not only provides discreet signal level changes immediately following the check digit printing operations (analogous to the pulse generated by the switch 29 in the embodiment of the invention discussed above and illustrated in FIGS. 1–3 and 5), but also provides an indication of which half cycle the check digit sleeve is entering. As explained below, this information serves to coordinate the operation of the control system. It will be appreciated that the single cam surface 114 and switch 112 arrangement may be replaced with a multiple cam, multiple switch, system should more versatility in timing be desired.

The output 115 of switch 112 is coupled to an interface circuit 116 within the interface/controller 111. As the signal level on output 115 changes, steady state BCD output 118 of the calculator 110 is transferred to the interface circuit 116. In turn, the steady state BCD output 119 of the interface circuit 116 is passed to a selected one of the buffer circuits 120 in accordance with the signal level on output 115. A multiplex circuit 121, also controlled by the output 115 of the switch 112, transmits the information stored in the other of the two buffer circuits 120 during the previous half cycle to the remainder of the interface/controller circuit. This remaining portion of the circuit operates in a manner similar to that illustrated in FIG. 5 and described above in connection with the single check digit wheel embodiment of FIGS. 1–3.

A comparator circuit 122 continually compares the steady state BCD output 124 of the multiplex circuit 121 with the changing BCD output 125 of the counter 126. The counter output 125 represents the number of stepping motor pulses generated by the pulse generator 128 and passed by the gate 129, as divided by the divider circuit 130 to correspond to the number of digits advanced by the wheel 102 being driven. The motor selection circuit 131, responsive to the output 115 of the switch 112, selects which of the two stepping motors 132 and 134 is to be driven. The dual outputs 135 and 136, each associated with one of the stepping motors 132 and 134, are transmitted to the stepping motors through the brush and slip ring arrangements generally indicated at 138 and 139.

It will be appreciated that a further extension of the present is possible through a system with a check digit sleeve having more than two check digit wheels spaced around the periphery thereof either through an extension of the time-sharing arrangement employed in FIG. 10, wherein a single calculator and associated multiplexing control circuitry drives one of the stepping motors during its pro rata share of the check digit sleeve revolution, or through the use of multiple calculator and control circuits. In the former, the control of the various stepping motors during only a pro rata portion of the check digit sleeve revolution in the manner illustrated in FIG. 10 may not allow sufficient time during which to advance the stepping motors in applications where high speed operation is an important consideration. In some cases, the problem may be relieved somewhat by incorporating acceleration and deceleration circuits into the control system to reduce the stepping motor advancement time. Also, circuitry to select the direction of stepping motor rotation to minimize the travel necessary to change from the previously printed check digit to the next-to-be printed check digit could be employed. Such an arrangement would eliminate the instances where, with single direction drive, the stepping motor must be driven more than half a revolution when, necessarily, the required rotation in the other direction would have been less than half a revolution.

I claim as my invention:

1. An apparatus for numbering a series of successively fed documents with serial numbers and check digits having a predetermined relationship to said serial numbers, including weighted-type check digits derived from said serial numbers, said apparatus comprising:

a mechanically-advanced multiple wheel rotary sequential numbering head for applying said serial numbers to said documents, said numbering head being mounted on a first shaft for rotary press-type operation;

a wheel having check digit indicia engraved around substantially the entire periphery thereof;

a rotatable sleeve upon which said wheel is mounted for rotation relative thereto to permit the selective establishment of the printing orientation of said wheel, said wheel having an axis of rotation which lies in a plane perpendicular to the rotary axis of said sleeve, said sleeve being mounted for rotation on a second shaft parallel to said first shaft;

means for rotating said sleeve about its rotary axis for applying said check digit indicia to said documents in rotary-press type operation;

a stepping motor mounted for rotation with said sleeve to selectively drive said wheel in either direction about its axis for selectively establishing the printing orientation of said wheel while said sleeve is rotated about its axis by said means in rotating said sleeve; and means for controlling the operation of said stepping motor including (a) means for successively deriving said check digits from said serial numbers, (b) means for determining the minimum rotation of said wheel required to change the position of said wheel from its previous printing orientation to the printing orientation required for printing of the next of said check digits and (c) means for generating signals to actuate said stepping motor to move said wheel through said minimum rotation.

2. An apparatus as set forth in claim 1 wherein said numbering head is mounted for selective relative lateral adjustment with respect to the path of said documents, and said rotating sleeve is mounted for selective lateral adjustment relative to said numbering head.

3. An apparatus as set forth in claim 1, wherein the angular phase between said rotatable shaft and said rotatable sleeve being adjustable.

4. An apparatus for numbering a series of successively fed documents with serial numbers and check digits having a predetermined relationship to said serial numbers, including weighted-type check digits derived from said serial numbers, said apparatus comprising:

at least one-mechanically advanced multiple wheel rotary sequential numbering head for applying said serial numbers to said documents, said numbering head being mounted on a first shaft for rotary press-type operation;

two wheels having check digit indicia engraved around substantially the entire periphery thereof;

a rotatable sleeve upon which said wheels are diametrically mounted for rotation relative thereto to permit the selective establishment of the printing orientation of each of said wheels, said wheels each having an axis of rotation which lies in a plane perpendicular to the axis of said sleeve, said sleeve being mounted for rotation on a second shaft parallel to said first shaft;

means for rotating said sleeve about its rotary axis for applying said check digit indicia to said documents in rotary press-type operation;

two stepping motors mounted for rotation with said sleeve to independently control the printing orientation of said wheels, said stepping motors selectively driving said wheels in either direction about their axes for selectively establishing the respective printing orientations of said wheels while said sleeve is rotated about its axis by said means in rotating said sleeve; and means selectively controlling the operation of said stepping motors including (a) means for successively deriving said check digits from said serial numbers, (b) means for determining the minimum rotation of said wheel required to change the position of said wheel from its previous printing orientation to the printing orientation required for printing of the next of said check digits and (c) means for generating signals to actuate said stepping motor to move said wheel through said minimum rotation.

5. An apparatus as set forth in claim 4, wherein the mounting of said numbering heads having provision for the laterial adjustment of said head with respect to said documents, said rotating sleeve also being laterally adjustable, said lateral adjustment of said rotating sleeve being independent from said lateral adjustment of said numbering heads.

6. An apparatus as set forth in claim 4, wherein the angular phase between said rotatable shaft and said rotatable sleeve being adjustable.

7. An apparatus as set forth in claim 4 wherein said wheels are selectively removable from said rotatable sleeve to permit operation of said apparatus with a single wheel.

8. An apparatus for numbering a series of successively fed documents with serial numbers and check digits having a predetermined relationship to said serial numbers, including weighted-type check digits derived from said serial numbers, said apparatus comprising:

a mechanically-advanced multiple wheel rotary sequential numbering head for applying said serial numbers to said documents, said numbering head being mounted on a first shaft for rotary-press type operation;

a wheel having check digit indicia engraved around substantially the entire periphery thereof;

a rotatable sleeve upon which said wheel is mounted for rotation relative thereto to permit the selective establishment of the printing orientation of said wheel, said wheel having an axis of rotation which lies in a plane perpendicular to the rotary axis of said sleeve, said sleeve being mounted for rotation on a second shaft parallel to said first shaft;

means for rotating said sleeve about its rotary axis for applying said check digit indicia to said documents in rotary-press type operation;

a stepping motor mounted for rotation with said sleeve to selectively drive said wheel about its axis for selectively establishing the printing orientation of said wheel while said sleeve is rotated about its axis by said means in rotating said sleeve; and means for controlling the operation of said stepping motor.

9. An apparatus for numbering a series of successively fed documents with serial numbers and check digits having a predetermined relationship to said serial numbers, including weighted-type check digits derived from said serial numbers, said apparatus comprising:

a wheel having check digit indicia engraved around substantially the entire periphery thereof;

a rotatable sleeve upon which said wheel is mounted for rotation relative thereto to permit the selective establishment of the printing orientation of said wheel, said wheel having an axis of rotation which lies in a plane perpendicular to the rotary axis of said sleeve;

means for rotating said sleeve about its rotary axis for applying said check digit indicia to said documents in rotary-press type operation;

a stepping motor mounted for rotation with said sleeve and having a rotatable shaft to selectively drive said wheel in either direction about its axis for selectively establishing the printing orientation of said wheel while said sleeve is rotated about its axis by said means for rotating said sleeve, said shaft of said stepping motor being parallel to the axis of said sleeve;

a direction-changing drive arrangement interposed between said stepping motor shaft and said wheel;

a mechanically-advanced multiple wheel rotary sequential numbering head for applying said serial numbers to said documents; and means for bringing the printing surface of said numbering head into and out of printing contact with said documents.

10. An apparatus for numbering a series of successively fed documents with serial numbers and check digits having a predetermined relationship to said serial numbers, including weighted-type check digits derived from said serial numbers, said apparatus comprising:

at least one-mechanically advanced multiple wheel rotary sequential numbering head for applying said serial numbers to said documents;

two wheels having check digit indicia engraved around substantially the entire periphery thereof;

a rotatable sleeve upon which said wheels are diametrically mounted for rotation relative thereto to permit the selective establishment of the printing orientation of each of said wheels, said wheels each having an axis of rotation which lies in a plane perpendicular to the axis of said sleeve, said sleeve being mounted for rotation on a second shaft parallel to said first shaft;

means for rotating said sleeve about its rotary axis for applying said check digit indicia to said documents in rotary press-type operation;

two stepping motors mounted for rotation with said sleeve to independently control the printing orientation of said wheels, said stepping motors selectively driving said wheels in either direction about their axes for selectively establishing the respective printing orientations of said wheels while said sleeve is rotated about its axis by said means for rotating said sleeve; and means selectively controlling the operation of said stepping motors.

* * * * *